US011642706B2

(12) United States Patent
Li et al.

(10) Patent No.: US 11,642,706 B2
(45) Date of Patent: May 9, 2023

(54) CLEANING DEVICE

(71) Applicant: KunShan Go-Visionox Opto-Electronics Co., Ltd, Kunshan (CN)

(72) Inventors: Qiangqiang Li, Kunshan (CN); Baoyou Wang, Kunshan (CN); Ce Chen, Kunshan (CN); Gang Fang, Kunshan (CN); Bolin Gan, Kunshan (CN)

(73) Assignee: KunShan Go-Visionox Opto-Electronics Co. Ltd, Kunshan (CN)

( * ) Notice: Subject to any disclaimer, the term of this patent is extended or adjusted under 35 U.S.C. 154(b) by 177 days.

(21) Appl. No.: 17/168,572

(22) Filed: Feb. 5, 2021

(65) Prior Publication Data

US 2021/0154708 A1 May 27, 2021

Related U.S. Application Data

(63) Continuation of application No. PCT/CN2019/106699, filed on Sep. 19, 2019.

(30) Foreign Application Priority Data

Jan. 9, 2019 (CN) ..... 201920033787.X

(51) Int. Cl.
*B08B 5/02* (2006.01)
*B08B 13/00* (2006.01)

(52) U.S. Cl.
CPC ..... *B08B 5/02* (2013.01); *B08B 13/00* (2013.01)

(58) Field of Classification Search
CPC ..... B08B 13/00; B08B 5/02
See application file for complete search history.

(56) References Cited

U.S. PATENT DOCUMENTS 7,172,979 B2 * 2/2007 Hongo ..... H01L 21/76849 257/E21.174
8,940,101 B2 * 1/2015 Jeong ..... H01L 21/67178 134/4

(Continued)

FOREIGN PATENT DOCUMENTS

CN 101145505 A 3/2008
CN 103286087 A 9/2013

(Continued)

OTHER PUBLICATIONS

International Search Report dated Nov. 28, 2019 in corresponding International application No. PCT/CN2019/106699; 6 pages.

*Primary Examiner* — Benjamin L Osterhout
(74) *Attorney, Agent, or Firm* — Maier & Maier, PLLC

(57) ABSTRACT

A cleaning device. The cleaning device includes: a base body, a spray head, and a main worktable and a first auxiliary worktable that are provided on the base body; a nozzle of the spray head is provided facing a mounting surface of the main worktable, and the spray head is configured to move in a preset direction vertical to the mounting surface to clean a to-be-cleaned panel on the mounting surface; the first auxiliary worktable is located at one end of the main worktable along the preset direction, and a first surface of the first auxiliary worktable facing the spray head is parallel to the mounting surface, and the first surface is higher than or flush with the mounting surface.

19 Claims, 2 Drawing Sheets

(56) References Cited

U.S. PATENT DOCUMENTS

| | | | | |
|---|---|---|---|---|
| 11,449,040 | B2 * | 9/2022 | Chien | G02F 1/1316 |
| 2002/0135730 | A1 * | 9/2002 | Ono | C11D 11/0047 349/187 |
| 2005/0127038 | A1 * | 6/2005 | Tannous | B08B 5/02 216/62 |

FOREIGN PATENT DOCUMENTS

| | | | |
|---|---|---|---|
| CN | 207307915 | U | 5/2018 |
| CN | 108369905 | A | 8/2018 |
| CN | 108568419 | A | 9/2018 |
| CN | 209363167 | U | 9/2019 |
| KR | 20100019156 | A | 2/2010 |

* cited by examiner

CLEANING DEVICE

CROSS-REFERENCE TO RELATED APPLICATIONS

This application is a continuation of International Application No. PCT/CN2019/106699, filed on Sep. 19, 2019. The International Application claims priority to Chinese Patent Application No. 201920033787.X, filed on Jan. 9, 2019. Both applications are hereby incorporated by reference in their entireties.

TECHNICAL FIELD

The present application relates to display panel manufacturing technology, in particular to a cleaning device.

BACKGROUND

In the manufacturing process of the display panel, it is necessary to sequentially attach a plurality of functional film layers onto the display panel, and the display panel needs to be cleaned before the functional film layer is attached, to eliminate impurities such as particles on the display panel. In the prior art, the display panel is often cleaned by cleaning device. The cleaning device includes a base body, a worktable provided on the base body, and a spray head provided on an upper part of the worktable. The worktable has a mounting surface facing away from the base body. When using, installing a to-be-cleaned panel onto the mounting surface, and controlling the spray head to spray a cleaning gas; and moving the spray head along one end of the worktable to the other end, and blowing off particles and other impurities on the to-be-cleaned panel by the cleaning gas, so as to realize the cleaning of the to-be-cleaned panel.

However, when the spray head moves to an edge of the worktable, there is no any obstruction at a bottom of the spray head. Impurities in other positions of the device will be blown up by the cleaning gas sprayed by the spray head and fall onto the to-be-cleaned panel, resulting in poor cleaning effect of the to-be-cleaned panel.

SUMMARY

An embodiment of the present application provides a cleaning device to solve technical problems that when a spray head moves to an edge of a worktable, there is no any obstruction at a bottom of the spray head, and impurities in other positions of the device will be blown up by a cleaning gas sprayed by the spray head and fall onto a to-be-cleaned panel, results in poor cleaning effect of the to-be-cleaned panel.

An embodiment of the present application provides a cleaning device, including:

a base body;

a main worktable;

a spray head, configured to move in a preset direction vertical to a mounting surface to clean a to-be-cleaned panel on the mounting surface and including a nozzle facing the mounting surface of the main worktable;

a first auxiliary worktable that are provided on the base body and located at one end of the main worktable along the preset direction, wherein a first surface of the first auxiliary worktable facing the spray head is parallel to the mounting surface, and the first surface is higher than the mounting surface or flush with the mounting surface.

The cleaning device provided in embodiments of the present application is that by setting the first auxiliary worktable at one end of the main worktable along the preset direction, with the first surface of the first auxiliary worktable being parallel to the mounting surface, and the first surface being flush with the mounting surface or higher than the mounting surface; when the spray head moves to one end of the main worktable in the preset direction, the first surface can prevent the cleaning gas sprayed by the spray head from blowing to other positions of the cleaning device, thereby avoiding blowing up the particles at the other positions and improving the cleaning effect.

DETAILED DESCRIPTION OF THE EMBODIMENTS

Figure 1:
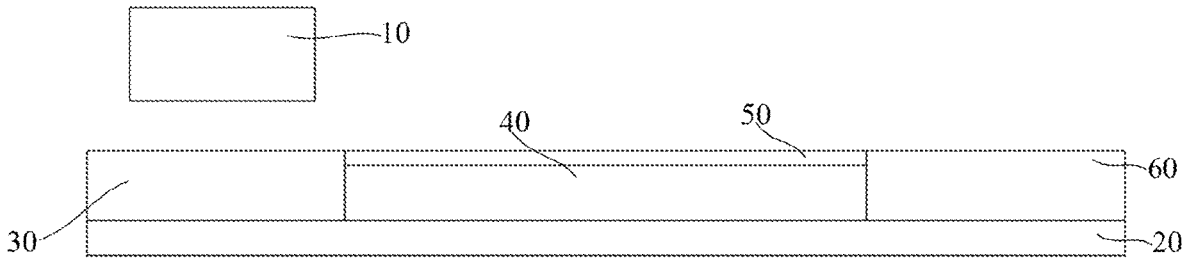
FIG. 1 is a first schematic structural diagram of a cleaning device provided by an embodiment of the present application.
Figure 2:
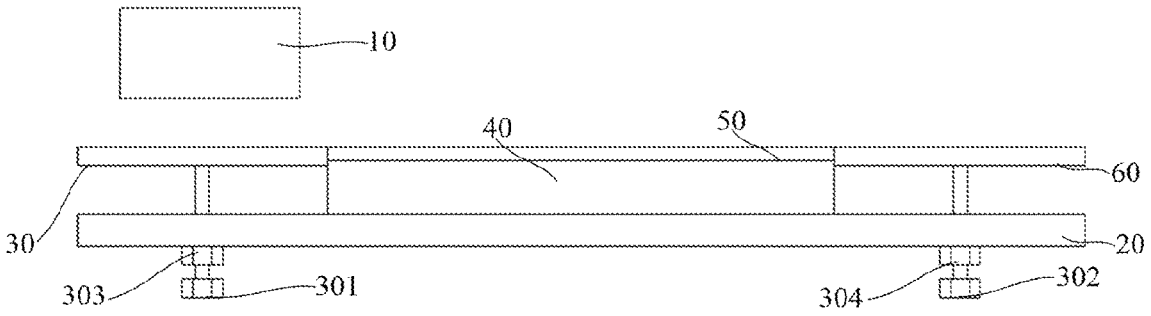
FIG. 2 is a second schematic structural diagram of a cleaning device provided by an embodiment of the present application.
Figure 3:
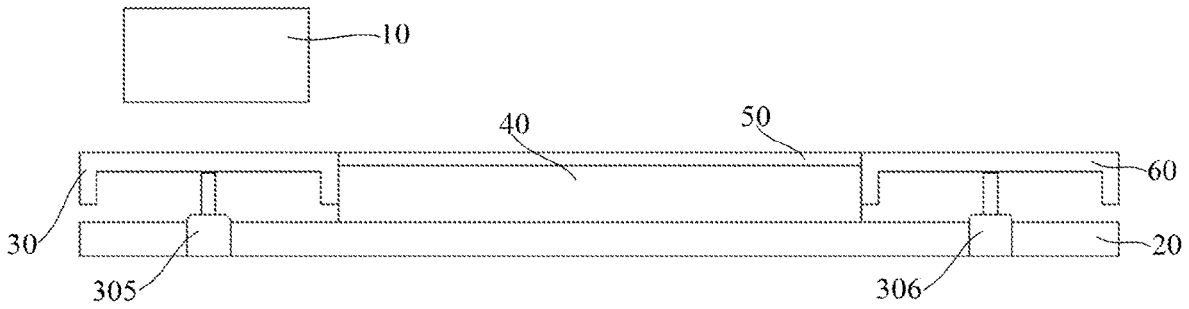
FIG. 3 is a third schematic structural diagram of a cleaning device provided by an embodiment of the present application.
Figure 4:
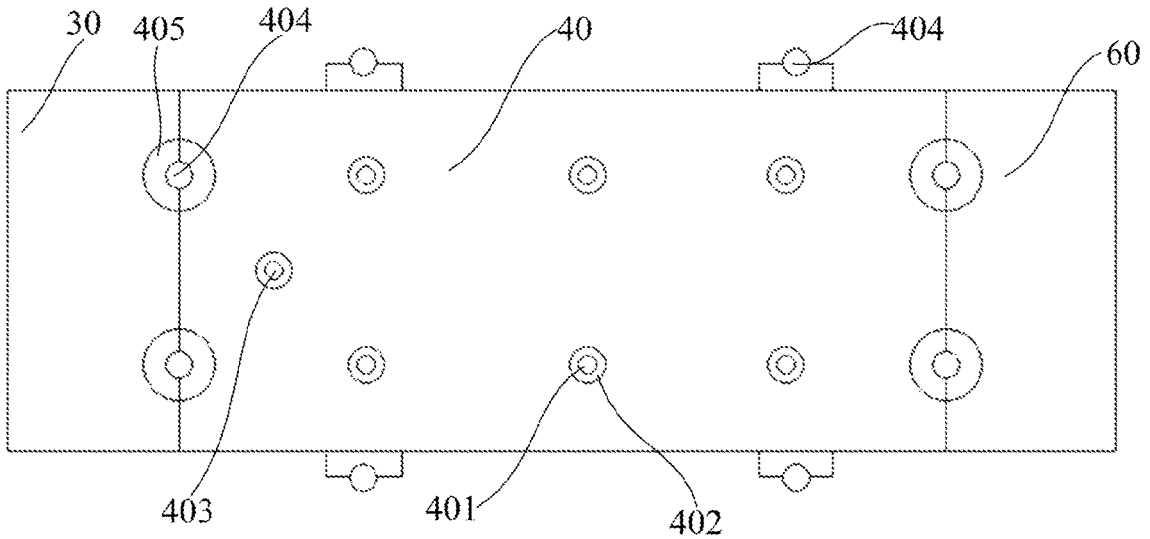
FIG. 4 is a top view of the cleaning device provided by an embodiment of the present application.

FIG. 1 is a first schematic structural diagram of a cleaning device provided by an embodiment of the present application; FIG. 2 is a second schematic structural diagram of a cleaning device provided by an embodiment of the present application; FIG. 3 is a third schematic structural diagram of a cleaning device provided by an embodiment of the present application; FIG. 4 is a top view of the cleaning device provided by an embodiment of the present application.

Referring to FIGS. 1-4, this embodiment provides a cleaning device including: a base body 20, a spray head 10, and a main worktable 40 and a first auxiliary worktable 30 provided on the base body 20, where a nozzle of the spray head 10 is provided facing a mounting surface of the main worktable 40, and the spray head 10 is configured to move in a preset direction to clean a to-be-cleaned panel 50 on the mounting surface; the first auxiliary worktable 30 is located at one end of the main worktable 40 along the preset direction, and a first surface of the first auxiliary worktable 30 facing the spray head 10 is parallel to the mounting surface, and the first surface is higher than the mounting surface or flush with the mounting surface.

In this embodiment, the base body 20 is set on the ground to carry the entire cleaning device; both the main worktable 40 and the first auxiliary worktable 30 are provided on the base body 20, the spray head 10 is provided on an upper part of the main worktable 40 and the spray head 10 is arranged to be spaced apart from the main worktable 40. The spray head 10 is configured to spray a cleaning gas to the to-be-cleaned panel 50 to remove impurities such as particles on the to-be-cleaned panel 50, thereby realizing cleaning of the to-be-cleaned panel 50. Preferably, the spray head 10 may spray gas such as nitrogen to the to-be-cleaned panel 50.

Specifically, the spray head 10 may be connected to the base body 20 through a driving cylinder, and a center line of the driving cylinder is parallel to the preset direction; when a piston rod of the driving cylinder is extended or retracted, the spray head 10 is driven to move on the upper part of the main worktable 40 in the preset direction. Or, a driving screw is rotatably provided on the base body 20, and an axis of the driving screw is parallel to the preset direction; a driving motor is drivably connected to the driving screw, and a driving nut matched with the driving screw is provided on the spray head 10, so that when the driving motor drives the screw to rotate, the driving nut and the spray head 10 are driven to move in the preset direction. The spray head 10 can also be connected to the base body 20 through other apparatus, as long as the spray head 10 can be driven to move in the preset direction.

In this embodiment, the mounting surface of the main worktable 40 may be a plane that is provided on the top of the main worktable 40 away from the ground, and is parallel to a horizontal plane, and the mounting surface is used to install the to-be-cleaned panel 50; correspondingly, the first surface on the first auxiliary worktable 30 is a plane that is provided on the top of the first auxiliary worktable 30 facing away from the ground and is parallel to the horizontal plane.

Specifically, the first auxiliary worktable 30 may be connected to the base body 20 by bolting or snapping. The first auxiliary worktable 30 is provided at one end of the main worktable 40 along a preset direction to form a first extension of the main worktable 40. When the spray head 10 moves to an end close to the first auxiliary worktable 30 in the preset direction, the first surface on the first auxiliary worktable 30 may block the cleaning gas, so as to prevent the cleaning gas from blowing up particles and other impurities in other positions of the cleaning device to fall on the to-be-cleaned panel 50.

In this embodiment, the first surface may be flush with the mounting surface, that is, the first surface and the mounting surface are provided parallel and coplanar, and in this case, a vertical distance between the spray head 10 and the first surface is equal to a vertical distance between the spray head 10 and the mounting surface; alternatively, the first surface is higher than the mounting surface, and the first surface higher than the mounting surface may reduce a distance between the first surface and the spray head 10, so that when the spray head 10 is moved to an end of the main worktable 40 facing the first auxiliary worktable 30, an air flow from the spray head 10 is relatively stable. Further, a vertical distance between the first surface and the main worktable 40 is equal to a thickness of the to-be-cleaned panel 50, so that the first surface is provided parallel and coplanar with a top surface of the to-be-cleaned panel 50 placed on the mounting surface, to further improve the stability of the air flow when the spray head 10 moves to the end of the main worktable 40 facing the end of the first auxiliary worktable 30.

Exemplarily, a vertical distance between the spray head 10 and the to-be-cleaned panel 50 may be 2 μm to 3 μm. Correspondingly, the vertical distance between the mounting surface and the spray head 10 is a sum of the vertical distance between the spray head 10 and the to-be-cleaned panel and the thickness of the to-be-cleaned panel 50. Of course, the distance between the spray head 10 and the to-be-cleaned panel 50 can also be other values, as long as the cleaning device has a good cleaning effect.

A working process of the cleaning device provided in this embodiment is as follows: first, the to-be-cleaned panel 50 is set on the mounting surface on the main worktable 40, and then the spray head 10 is controlled to spray the cleaning gas and meanwhile is controlled to move in a preset direction, and during the movement of the spray head 10, the sprayed cleaning gas blows away impurities such as particles adhered to the to-be-cleaned panel 50, so as to realize cleaning of the to-be-cleaned panel 50. When the spray head 10 moves to the end of the main worktable 40 facing the first auxiliary worktable 30, the cleaning gas sprayed from the spray head 10 blows onto the first surface of the first auxiliary worktable 30. The first surface prevents the cleaning gas from blowing onto other positions of the cleaning device, and thus avoids blowing up particles and other impurities at the other positions of the cleaning device.

The cleaning device provided in the embodiments of the present application is that by setting the first auxiliary worktable 30 at one end of the main worktable 40 along the preset direction, with the first surface on the first auxiliary worktable 30 being parallel to the mounting surface, and the first surface being flush with the mounting surface or higher than the mounting surface; when the spray head 10 moves to the end of the main worktable 40 facing the first auxiliary worktable 30 in the preset direction, the first surface can prevent the cleaning gas sprayed by the spray head 10 from blowing to other positions of the cleaning device, thereby avoiding particles at the other positions to be blown up, and improving the cleaning effect.

In this embodiment, the first auxiliary worktable 30 is connected to the base body 20 through a first lifting apparatus. The first lifting apparatus is used to drive the first auxiliary worktable 30 to move in a direction vertical to the first surface. The distance between the first surface and the mounting surface can be adjusted by the first lifting apparatus to ensure that the first surface is flush with the top surface of the to-be-cleaned panel 50 installed on the mounting surface; the display panels with different thicknesses can be cleaned, which improves the versatility of cleaning device.

Exemplarily, the first lifting apparatus drives the first auxiliary worktable 30 to move in a range of 0 mm to 3 mm in a direction vertical to the first surface. Preferably, the first lifting apparatus drives the first auxiliary worktable 30 to move in a range of 1 mm in a direction vertical to the first surface.

Referring to FIG. 2, in a feasible embodiment, the first lifting apparatus may include a first lifting bolt 301, and a first threaded hole provided on the base body 20 and having a center line vertical to the first surface, where the first lifting bolt 301 can be screwed into the first threaded hole, and the first lifting bolt 301 abuts against the first auxiliary worktable 30; by twisting the first lifting bolt 301, the first auxiliary worktable 30 can be driven to move in a direction vertical to the first surface.

Further, the first lifting apparatus further includes a first locking nut 303 fitted with the first lifting bolt 301. After adjusting the height of the first auxiliary worktable 30 by twisting the first lifting bolt 301, the first locking nut 303 is tightened, so that the first locking nut 303 abuts against the base body 20, and then a friction between the first locking nut 303 and the base body 20 prevents the first lifting bolt 301 from rotating, in order to avoid the rotation of the first lifting bolt 301 caused by the shaking of the base body 20 during cleaning, and thus height change of the first auxiliary worktable 30.

Referring to FIG. 3, in other embodiments, the first lifting apparatus may further include a first telescopic cylinder 305, and the cylinder body of the first telescopic cylinder 305 is connected to the base body 20, and a piston rod of the first telescopic cylinder 305 is connected to the first auxiliary worktable 30, so that when the piston rod of the first telescopic cylinder 305 is extended out from the cylinder body, the first auxiliary worktable 30 is driven to move upward, and when the piston rod of the first telescopic cylinder 305 is retracted towards the cylinder body, the first auxiliary worktable 30 is driven to move downwards.

In this embodiment, the main worktable 40 may be provided with a first slide rail, and a center line of the first slide rail is vertical to the mounting surface. The first auxiliary worktable 30 is provided with a first slide groove, and the first slide rail is slidably provided in the first slide groove, so as to improve the stability of the first auxiliary worktable 30.

In this embodiment, the cleaning device further includes a second auxiliary worktable 60. The second auxiliary worktable 60 is provided at the other end of the main worktable 40 along a preset direction, and a second surface of the second auxiliary worktable 60 towards the spray head 10 is parallel to the mounting surface. The second surface is higher than the mounting surface or flush with the mounting surface. The first auxiliary worktable 30 is located at one end of the main worktable 40 in the preset direction, and the second auxiliary worktable 60 is located at the other end of the main worktable 40 in the preset direction, so that when the spray head 10 moves to both ends of the main worktable 40 in the preset direction, the gas sprayed by the spray head 10 will be blocked, so as to avoid blowing up particles and other impurities in other positions of the cleaning device, so as to further improve the cleaning effect of the cleaning device. Preferably, the spray head 10 can be moved back and forth in a preset direction to perform multiple cleanings on the to-be-cleaned panel 50, which can further improve the cleaning effect.

In this embodiment, the second auxiliary worktable 60 is provided at the other end of the main worktable 40 along the preset direction, that is, the second auxiliary worktable 60 is a second extension portion outward from the other end of the main worktable 40. The second surface of the second auxiliary worktable 60 may be flush with the mounting surface, that is, the second surface and the mounting surface is provided parallel and coplanar. At this time, a distance between the spray head 10 and the second surface is equal to a distance between the spray head 10 and the mounting surface; or the second surface is higher than the mounting surface; the second surface higher than the mounting surface can reduce the distance between the second surface and the spray head 10, so that when the spray head 10 moves to the other end of the main worktable 40, the air flow sprayed from the spray head 10 is relatively stable. Further, a distance between the second surface and the main worktable 40 is equal to a thickness of the to-be-cleaned panel 50, so that the second surface is parallel to and coplanar with the top surface of the to-be-cleaned panel 50 placed on the mounting surface, to further improve the stability of the air flow when the spray head 10 moves to the other end of the main worktable 40.

In this embodiment, the first surface and the second surface may be provided parallel and coplanar, or provided parallel and non-coplanar.

In this embodiment, the second auxiliary worktable 60 is connected to the base body 20 through a second lifting apparatus. The second lifting apparatus is used to drive the second auxiliary worktable 60 to move in a direction vertical to the second surface. The distance between the second surface and the mounting surface can be adjusted by the second lifting apparatus to ensure that the second surface is flush with the top surface of the to-be-cleaned panel 50 installed on the mounting surface; the to-be-cleaned panels 50 with different thicknesses can be cleaned, which improves the versatility of the cleaning device.

Exemplarily, the second lifting apparatus drives the second auxiliary worktable 60 to move in a direction vertical to the second surface in a range of 0 mm to 3 mm. Preferably, the second lifting apparatus drives the second auxiliary worktable 60 to move in a direction vertical to the second surface in a range of 1 mm.

Referring to FIG. 2, in a feasible embodiment, the second lifting apparatus may include a second lifting bolt 302, and a second threaded hole that is provided on the base body 20 and having a center line vertical to the second plane, and the second lifting bolt 302 can be screwed into the second threaded hole, and the second lifting bolt 302 abuts against the second auxiliary worktable 60; by twisting the second lifting bolt 302, the second auxiliary worktable 60 can be driven to move in a direction vertical to the second plane.

Further, the second lifting apparatus further includes a second locking nut 304 fitted with the second lifting bolt 302. After adjusting the height of the second auxiliary worktable 60 by twisting the second lifting bolt 302, the second locking nut 304 is tightened, so that the second locking nut 304 abuts against the base body 20, and then the friction between the second locking nut 304 and the base body 20 prevents the second lifting bolt 302 from rotating, so as to avoid the rotation of the second lifting bolt 302 caused by the shaking of the base body 20 during cleaning, and thus height change of the second auxiliary worktable 60.

Referring to FIG. 3, in other embodiments, the second lifting apparatus may further include a second telescopic cylinder 306, and a cylinder body of the second telescopic cylinder 306 is connected to the base body 20, and a piston rod of the second telescopic cylinder 306 is connected to the second auxiliary worktable 60, so that when the piston rod of the second telescopic cylinder 306 is extended out from the cylinder body, the second auxiliary worktable 60 is driven to move upward, and when the piston rod of the second telescopic cylinder 306 is retracted towards the cylinder body, the second auxiliary worktable 60 is driven to move downwards.

In this embodiment, a second slide rail may be provided on the main worktable 40, and a center line of the second slide rail is vertical to the mounting surface. The second auxiliary worktable 60 is provided with a second slide groove, and the second slide rail is slidably provided in the second slide groove, so as to improve the stability of the second auxiliary worktable 60.

Referring to FIG. 4, in this embodiment, the cleaning device further includes a plurality of supporting columns 401. The main worktable 40 is provided with a plurality of telescopic holes 402 whose center lines are vertical to the mounting surface and each supporting column 401 is provided in one telescopic hole 402; the supporting columns 401 are connected to the main worktable 40 through a telescopic apparatus, the telescopic apparatus is used to drive the supporting column 401 extending out from or retracting into the telescopic hole 402.

When using, first, the supporting columns 401 are driven to extend out from the telescopic holes 402 by the telescopic apparatus, then the to-be-cleaned panel 50 is placed on tops of the supporting columns 401, and then the supporting columns 401 are driven to retract into the telescopic holes 402 by the telescopic apparatus so that the to-be-cleaned panel 50 falls on the mounting surface. On the contrary, after cleaning, the supporting columns 401 are driven by the telescopic apparatus to extend out from the telescopic holes 402, and then each supporting column 401 abuts against the to-be-cleaned panel 50, so that the to-be-cleaned panel 50 is separated from the mounting surface, and then the to-be-cleaned panel 50 is removed from the supporting columns 401. This facilitates placement and removal of the to-be-cleaned panel 50.

Further, there may be various types of telescopic apparatus, as long as the supporting columns 401 can be driven to extend out from or retract into the telescopic holes 402 into the telescopic hole 402. For example, the telescopic apparatus may include cylinders, the cylinders and the supporting columns 401 are all provided in the telescopic holes 402, the cylinder bodies of the cylinders are connected to the main worktable 40, and piston rods of the cylinders are connected to the supporting columns 401. When the piston rods extend out from the cylinders, the supporting columns 401 are driven to extend out from the telescopic holes 402; when the piston rods retract into the cylinders, the supporting columns 401 are driven to retract into the telescopic holes 402. The telescopic apparatus may also include hydraulic cylinders and the like.

Referring to FIG. 4, in this embodiment, the cleaning device further includes at least one detection apparatus 403 provided on the main worktable 40. The detection device 403 is used to detect the to-be-cleaned panel 50. When the detection apparatus 403 detects that the supporting columns 401 have the to-be-cleaned panel 50, the supporting columns are controlled to retract into the telescopic holes 402. The detection apparatus 403 can detect whether there is the to-be-cleaned panel 50 on the supporting columns 401, so as to control the supporting columns 401.

Exemplarily, when the detection apparatus 403 does not detect the to-be-cleaned panel 50, the telescopic apparatus is controlled to drive the supporting columns 401 to extend out from the telescopic holes 402 to receive the to-be-cleaned panel 50; when the detection apparatus 403 detects the presence of the to-be-cleaned panel 50 on the supporting columns 401, the telescopic apparatus is controlled to drive the supporting columns 401 to retract into the telescopic holes 402, so that the to-be-cleaned panel 50 falls on the mounting surface.

There may be various types of detection apparatuses 403 in this embodiment. For example, the detection apparatus 403 may include an infrared emitter and an infrared receiver, and both the infrared emitter and the infrared receiver are provided on the main worktable 40. When there is the to-be-cleaned panel 50 on the supporting columns 401, infrared rays emitted by the infrared emitter are reflected by the to-be-cleaned panel 50 and then received by the infrared receiver; when there is no to-be-cleaned panel 50 on the supporting columns 401, the infrared receiver cannot receive the infrared rays. The detection apparatus 403 may further include a button. When there is the to-be-cleaned panel 50 on the supporting columns 401, the to-be-cleaned panel 50 presses the button, and then it is detected that there is the to-be-cleaned panel 50 on the supporting columns 401. At this time, the detection apparatus 403 is movably provided along the mounting surface vertical to the main worktable 40. A driving structure of the detection apparatus 403 can refer to the driving structures of the supporting columns 401.

Referring to FIG. 4, in this embodiment, the cleaning device further includes a plurality of limiting members 404 provided on the main worktable 40 and surrounding the mounting surface. The limiting members 404 are connected to the main worktable 40 through a moving apparatus. The moving apparatus is used for driving the limiting members 404 to move, so that the limiting members 404 abut against the to-be-cleaned panel 50, and then adjusts the position of the to-be-cleaned panel 50 on the main worktable 40 so that the spray head 10 is facing the to-be-cleaned panel 50.

In this embodiment, the limiting members 404 each may include a column and a wear resistant part provided at the top of the column. The wear resistant part is in contact with the to-be-cleaned panel 50 to prevent the to-be-cleaned panel 50 from scratching the limiting members 404, resulting in insufficient dimensional accuracy of the limiting members 404. Preferably, the wear resistant part may be mainly composed of polyetheretherketone. The wear resistant part can also be composed of other wear resistant material.

The limiting members 404 in this embodiment may move in a direction parallel to the preset direction, or in a direction parallel to the mounting surface and vertical to the preset direction, so as to adjust the position of the to-be-cleaned panel 50. In addition, the limiting members 404 can also move in a direction vertical to the mounting surface, to adjust heights of the limiting members 404.

Exemplarily, the limiting members 404 each includes a first main body and a second main body, and the first main body may be connected to the base body 20 through a first driving apparatus. The first driving apparatus may be an apparatus capable of driving the first main body to move in a direction parallel to the preset direction, e.g., a hydraulic cylinder, an air cylinder, an electric push rod, etc.; the second main body and the first main body are connected by a second driving apparatus, and the second driving apparatus may be an apparatus capable of driving the second main body to move in a direction parallel to the mounting surface and vertical to the preset direction, e.g., a hydraulic cylinder, an air cylinder, an electric push rod, etc.; the column is connected to the second main body through a third driving apparatus. The third driving apparatus may be an apparatus capable of driving the column to move in a direction vertical to the mounting surface, e.g., a hydraulic cylinder, an air cylinder, or the like.

When working, the column is driven by the third driving apparatus to move upward, so that the wear resistant part on the column is flush with the to-be-cleaned panel 50; after that, the first driving apparatus and/or the second driving apparatus are operated to drive the first main body and the second main body to move in a preset direction, and/or drive the second main body to move in a direction parallel to the mounting surface and vertical to the preset direction, so that the wear resistant part abuts against an edge of the to-be-cleaned panel 50, so as to drive the to-be-cleaned panel 50 to move, so as to adjust a position of the to-be-cleaned panel 50.

Referring to FIG. 4, in this embodiment, the end of the first auxiliary worktable 30 facing the main worktable 40 is provided with a first recessed portion, and the end of the main worktable 40 facing the first auxiliary worktable 30 is provided with a second recessed portion. The first recessed portion and the second recessed portion surround to form a receiving groove 405, and in the limiting members a limiting member 404 between the main worktable 40 and the first auxiliary worktable 30 is provided in the receiving groove 405. When cleaning, the limiting member 404 is controlled by the movement of the moving apparatus to retract into the receiving groove 405, preventing the limiting member 404 from blocking the movement of the spray head 10 during cleaning.

Further, a third recessed portion is provided at an end of the second auxiliary worktable 60 facing the main worktable 40, and a fourth recessed portion is provided at an end of the main worktable 40 facing the second auxiliary worktable 60. The third recessed portion and the fourth recessed portion surround to form a receiving groove 405, and in the limiting members a limiting member 404 between the main worktable 40 and the second auxiliary worktable 60 is provided in the receiving groove 405. This can prevent the limiting member between the second auxiliary worktable 60 and the main worktable 40 from blocking the movement of the spray head 10.

A using process of the cleaning device provided in this embodiment is: first, the supporting columns 401 are driven by the telescopic apparatus to extend out of the telescopic hole 402 to receive the to-be-cleaned panel 50; after that, the to-be-cleaned panel 50 is placed on the tops of the supporting columns 401; after that, the moving apparatus drives the limiting members 404 to extend away from the mounting surface, and makes the wear resistant part of the limiting members 404 face the edge of the to-be-cleaned panel 50; after that, the driving limiting members 404 are moved in a preset direction and/or a direction parallel to the mounting surface and vertical to the preset direction by the moving apparatus, and the wear resistant part abuts against the edge of the to-be-cleaned panel 50 to adjust the position of the to-be-cleaned panel 50; afterwards, the supporting columns 401 are retracted into the telescopic holes 402 by the telescopic apparatus to place the to-be-cleaned panel 50 on the mounting surface, and the limiting member 404 between the first auxiliary worktable 30 and the main worktable 40 and the limiting member 404 between the second auxiliary worktable 60 and the main worktable 40 are retracted into corresponding receiving grooves 405; after that, the first auxiliary worktable 30 is driven by the first lifting apparatus to move in a direction vertical to the mounting surface, so that the first surface is flush with the top surface of the to-be-cleaned panel 50, and at the same time, the second auxiliary worktable 60 is driven by the second lifting apparatus to move in a direction vertical to the mounting surface, so that the second surface is flush with the top surface of the to-be-cleaned panel 50; after that, the spray head 10 is sprayed with a cleaning gas, and the spray head is moved in a preset direction to clean the to-be-cleaned panel 50; after the cleaning is completed, the supporting columns 401 are driven by the telescopic apparatus to extend out of the telescopic holes 402 to move upward against the to-be-cleaned panel 50, so that the to-be-cleaned panel 50 is separated from the mounting surface.

Finally, it should be noted that the above embodiments are only to illustrate the technical solutions of the present application, and not to limit them; although this application has been described in detail with reference to the foregoing embodiments, those skilled in the art should understand: they can still modify the technical solutions described in the foregoing embodiments, or equivalently replace some or all of the technical features therein; however, these modifications or replacements do not deviate the essence of the corresponding technical solutions from the scope of the technical solutions of the embodiments of the present application.

What is claimed is:

1. A cleaning device configured to clean a display panel, comprising:

a base body;

a main worktable;

a spray head configured to move in a preset direction vertical to a mounting surface of the main worktable to clean a to-be-cleaned panel on the mounting surface of the main worktable and including a nozzle provided facing the mounting surface of the main worktable; and a first auxiliary worktable that is provided on the base body and located at one end of the main worktable along the preset direction vertical to the mounting surface, wherein a first surface of the first auxiliary worktable facing the spray head is parallel to the mounting surface, and the first surface is higher than the mounting surface or flush with the mounting surface.

2. The cleaning device according to claim 1, wherein a height difference between the first surface and the mounting surface is equal to a thickness of the to-be-cleaned panel.

3. The cleaning device according to claim 1, wherein the first auxiliary worktable is connected to the base body through a first lifting apparatus, and the first lifting apparatus is configured to drive the first auxiliary worktable to move in a direction vertical to the first surface.

4. The cleaning device according to claim 3, wherein the first lifting apparatus comprises a first lifting bolt and a first threaded hole that is provided on the base body and having a center line vertical to the first surface, wherein the first lifting bolt is capable of screwing into the first threaded hole, and the first lifting bolt abuts against the first auxiliary worktable.

5. The cleaning device according to claim 4, wherein the first lifting apparatus further comprises a first locking nut fitted with the first lifting bolt.

6. The cleaning device according to claim 3, wherein the first lifting apparatus comprises a first telescopic cylinder, a cylinder body of the first telescopic cylinder is connected to the base body, and a piston rod of the first telescopic cylinder is connected to the first auxiliary worktable.

7. The cleaning device according to claim 1, wherein the main worktable is provided with a first slide rail, a center line of the first slide rail is vertical to the mounting surface, the first auxiliary worktable is provided with a first slide groove, and the first slide rail is provided in the first slide groove.

8. The cleaning device according to claim 1, further comprising a second auxiliary worktable, wherein the second auxiliary worktable is provided at the other end of the main worktable along the preset direction, and a second surface of the second auxiliary worktable facing the spray head is parallel to the mounting surface, and the second surface is higher than or flush with the mounting surface.

9. The cleaning device according to claim 8, wherein the first surface and the second surface are provided parallel and coplanar, or provided parallel and non-coplanar.

10. The cleaning device according to claim 8, wherein the second auxiliary worktable is connected to the base body through a second lifting apparatus, and the second lifting apparatus is configured to drive the second auxiliary worktable to move in a direction vertical to the second surface.

11. The cleaning device according to claim 1, further comprising a plurality of supporting columns, wherein the main worktable is provided with a plurality of telescopic holes whose center lines are vertical to the mounting surface, each of the supporting columns is provided in one of the telescopic holes, the supporting columns are connected to the main worktable through a telescopic apparatus, and the telescopic apparatus is configured to drive the supporting columns extending out from or retracting into the telescopic hole.

12. The cleaning device according to claim 11, wherein the cleaning device further comprises at least one detection apparatus provided on the main worktable, and the detection apparatus is configured to detect the to-be-cleaned panel located on the supporting columns.

13. The cleaning device according to claim 1, further comprising a plurality of limiting members provided on the main worktable and surrounding the mounting surface, wherein the limiting members are connected to the main worktable through a moving apparatus, and the moving apparatus is configured to move the limiting members to abut against the to-be-cleaned panel, thereby adjusting a position of the to-be-cleaned panel on the main worktable.

14. The cleaning device according to claim 13, wherein the limiting members move in a direction parallel to the preset direction, in a direction parallel to the mounting surface and vertical to the preset direction, or in a direction vertical to the mounting surface.

15. The cleaning device according to claim 13, wherein at least one first recessed portion is provided at an end of the first auxiliary worktable facing the main worktable, at least one second recessed portion is provided at an end of the main worktable facing the first auxiliary worktable, each of the at least one first recessed portion and a corresponding one of the at least one second recessed portion form a receiving groove therebetween, and each of the limiting members located between the main worktable and the first auxiliary worktable is received in a corresponding receiving groove.

16. The cleaning device according to claim 13, wherein the limiting member comprises a column and a wear resistant part provided at a top of the column.

17. The cleaning device according to claim 16, wherein each of the limiting members comprises a first main body and a second main body, the first main body is connected to the base body through a first driving apparatus, and the first driving apparatus is an apparatus capable of driving the first main body to move in a direction parallel to the preset direction.

18. The cleaning device according to claim 17, wherein the second main body and the first main body are connected by a second driving apparatus, and the second driving apparatus is an apparatus capable of driving the second main body to move in a direction parallel to the mounting surface and vertical to the preset direction.

19. The cleaning device according to claim 18, wherein the column is connected to the second main body through a third driving apparatus, and the third driving apparatus is an apparatus capable of driving the column to move in a direction vertical to the mounting surface.

* * * * *